United States Patent [19]

Kaffka

[11] 4,129,070

[45] Dec. 12, 1978

[54] BALING PRESSES FOR THE PRODUCTION OF BOUND BALES

[75] Inventor: Dietmar Kaffka, Willich, Fed. Rep. of Germany

[73] Assignee: Lindemann Maschinenfabrik GmbH, Dusseldorf, Fed. Rep. of Germany

[21] Appl. No.: 843,543

[22] Filed: Oct. 19, 1977

[30] Foreign Application Priority Data

Jun. 23, 1977 [DE] Fed. Rep. of Germany ..... 2728203

[51] Int. Cl.[2] ..... B65B 13/18

[52] U.S. Cl. ..... 100/17; 100/295

[58] Field of Search ..... 100/295, 17, 18, 19, 100/20, 21, 22, 23, 24, 3, 179; 56/448

[56] References Cited

U.S. PATENT DOCUMENTS

| | | | |
|---|---|---|---|
| 650,494 | 5/1900 | Sooy | 100/24 X |
| 1,075,376 | 10/1913 | Pearson | 100/22 X |
| 3,159,097 | 12/1964 | White | 100/295 X |

FOREIGN PATENT DOCUMENTS

| | | | |
|---|---|---|---|
| 2259384 | 6/1974 | Fed. Rep. of Germany | 100/295 |

*Primary Examiner*—Billy J. Wilhite

*Attorney, Agent, or Firm*—Toren, McGeady and Stanger

[57] ABSTRACT

A baling press which is intended for the production of bound bales of predominantly non-metallic waste material and which comprises a pressing box and a pressing plunger which is movable to and fro in the pressing box, has its plunger provided with a binding comb which is movable relative to the plunger in the direction of pressing movement of the plunger. The binding comb comprises a plurality of plates which are mounted parallel to and spaced apart from one another, the plates being movable between a forward position in which they project beyond the pressing face of the plunger and form between them a plurality of grooves for the passage of binding wire in front of the plunger, and a retracted position in which their front edges form parts of the pressing face of the plunger. These plates are preferably guided in apertures in a front wall, which forms the pressing face, of the pressing plunger and the size and shape of the apertures corresponds to the cross-section of the front portions of the plates so that the front portions of the plates fit in the apertures and cause the front face of the plunger to be substantially uninterrupted when the plates are in their retracted position.

5 Claims, 4 Drawing Figures

BALING PRESSES FOR THE PRODUCTION OF BOUND BALES

This invention relates to baling presses for the production of bound bales of predominantly non-metallic waste material, the press comprising a pressing box and a pressing plunger which is movable to and fro in the pressing box.

To produce a bound bale, the material to be baled is filled into the pressing box with the plunger retracted. A number of forward and retraction strokes of the pressing plunger, after each retraction stroke of which a filling operation takes place, results in the pressing of a bale which, after the last forward stroke required for its production, is bound while the pressing plunger remains advanced. In existing presses binding grooves, which extend vertically and parallel to one another in the end face of the pressing plunger, serve for the passage of binding wire in the binding operation, after completion of which the pressing plunger is retracted. The binding wire, which is guided through the binding grooves in the pressing plunger, remains on the bale and is released from the pressing plunger by the open fronts of the binding grooves in the front face of the pressing plunger.

Various materials have a particular tendency during pressing to penetrate into the binding grooves under the pressing pressure and to jam in them and clog the grooves so that the binding wires, which have been threaded through the binding grooves while the plunger is fully advanced, are prevented from leaving the binding grooves as the pressing plunger is subsequently retracted. This causes destruction of the binding and damage to the bale which has just been bound. This results in a considerable loss of production by the baling press.

One proposal for overcoming this difficulty is disclosed in German Offenlegungsschrift No. 25 52 722. According to this proposal, the binding grooves are formed at an acute angle into the pressing face of the plunger, so that the pressed material cannot penetrate into the binding grooves in a straight line in the pressing direction. In practice, this form of construction has proved extremely satisfactory particularly in the pressing of old textile waste material which is a material which is highly extensible and also cannot be cut by a binding wire. However, the aforementioned difficulty still occurs and is especially frequent in the pressing of refuse, which as is well known may have a completely unpredictable composition of solid, doughy, wooden, textile, metallic and other materials of a coarse and fine nature which not only stick in the outlets of the binding grooves, but can jam the whole of the binding grooves so that a frictionless feeding of the wire between the plunger and the bale in a binding operation is no longer possible.

The aim of the present invention is so to construct a baling press for the production of bound bales of predominantly non-metallic waste material and of the kind comprising a pressing box and a pressing plunger which is movable to and fro in the pressing box so that the binding operation and the retraction of the pressing plunger after binding is completed can be carried out in a trouble-free manner even when the most difficult materials are being baled.

To this end, according to this invention, in such a baling press, the plunger is provided with a binding comb which is movable relative to the plunger and comprises a plurality of plates which are mounted parallel to and spaced apart from one another, the plates being adapted to move between a forward position in which they project beyond the pressing face of the plunger and form between them a plurality of grooves for the passage of binding wire in front of the plunger and a retracted position in which their front edges form parts of the pressing face of the plunger.

By this arrangement, the result is attained that the pressing plunger has, during pressing, a substantially uninterrupted pressing face, which absolutely prevents the penetration of pressed material. Only after a full bale has been formed are the plates of the binding comb moved to their forward position relative to the plunger as the plunger is simultaneously retracted by an amount which permits passage of the binding needles between the rear face of the bale and the pressing face of the plunger. The binding needles thus pass through the pressing box to conduct wire binding loops, in front of the pressing face of the pressing plunger, while the projecting plates of the binding comb press against the bale and prevent it from expanding.

Preferably, the plates of the binding comb are guided in apertures in a front wall, which forms the pressing face, of the pressing plunger, the size and shape of the apertures corresponding to the cross-section of the front portions of the plates. This makes it impossible, either in the retracted or in the forward position of the binding comb, for foreign matter to penetrate through the pressing face into the plunger.

In a preferred embodiment of the invention, a synchronous movement of all the plates is attained by the plates being fixed within the plunger to a connecting beam which extends through the pressing plunger perpendicularly to the pressing direction.

The binding comb is brought into the operating position with its plates in their forward position by being held fixed when the plunger is in the limiting pressing position, that is its most forward position, after which the plunger is retracted by the distance by which the plates of the binding comb project from the pressing face. For this purpose, the connecting beam is with advantage guided in longitudinal slots in opposite side walls of the pressing plunger, the beam being adapted to be locked in position, when the plunger is in its limiting pressing position, by means of locking pins which are introduced through adjacent side walls of the pressing box.

Preferably, hydraulic cylinders are mounted on the side walls of the pressing box for introducing and retracting the locking pins.

An example of a baling press in accordance with the invention is illustrated in the accompanying somewhat diagrammatic drawings, in which:-

Figure 1:
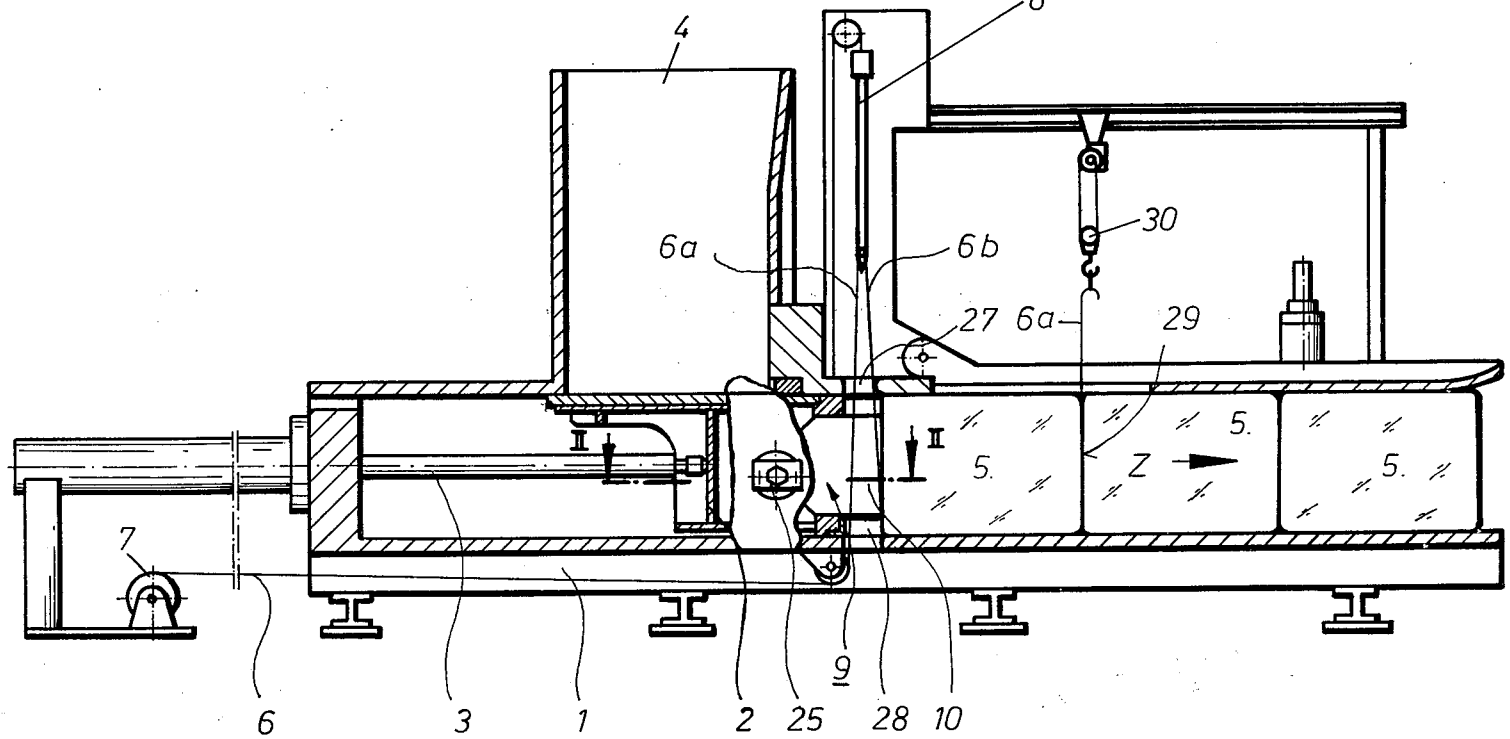
FIG. 1 is a longitudinal section through the press.

The press comprises a pressing box 1 of rectangular cross-section, in which a pressing plunger 2 is slidably mounted under the control of a hydraulic cylinder 3. In FIG. 1, the pressing plunger 2 is shown in the advanced position in the direction of pressing. When the plunger is retracted, material to be pressed into bales is introduced through a filler shaft 4, leading into the top of the pressing box. In order to produce each bale, several forward and retraction strokes of the plunger are required. In the pressing box 1 shown in FIG. 1, three already pressed bales 5 are situated, of which the middle and right-hand ones have already been bound with wire, while the left-hand one is just about to be bound.

For the purpose of binding, several loops of binding wire 6 are required for each bale, these loops being drawn from a number of storage rolls 7 corresponding to the number of the loops. In the present example, there are five loops of binding wire, so that the elements essential for binding are provided fivefold.

As shown in FIG. 1, a binding needle 8 has just raised a wire loop 6a, 6b from the bottom of the pressing box transversely upwards through the pressing box and behind the left-hand bale 5 to be bound. At this stage of operations, the pressing plunger 2 is, in existing baling presses, situated in the limiting pressing position, that is in its furthest forward position, in order that the bale shall be prevented from expanding during the binding operation. The passage of the binding needles 8 is effected, in existing baling presses, through binding grooves extending parallel to one another through the front face of the pressing plunger. In the present invention the binding grooves in the conventional sense are dispensed with for the reasons already explained. Instead, the pressing plunger 2 is provided with a binding comb which is designated by the general reference 9, and consists of a plurality of plates 10 disposed parallel to one another and fixed with spaces between them to a connecting beam 11, which passes through the pressing plunger 2 perpendicularly to the pressing direction Z.

Figure 3:
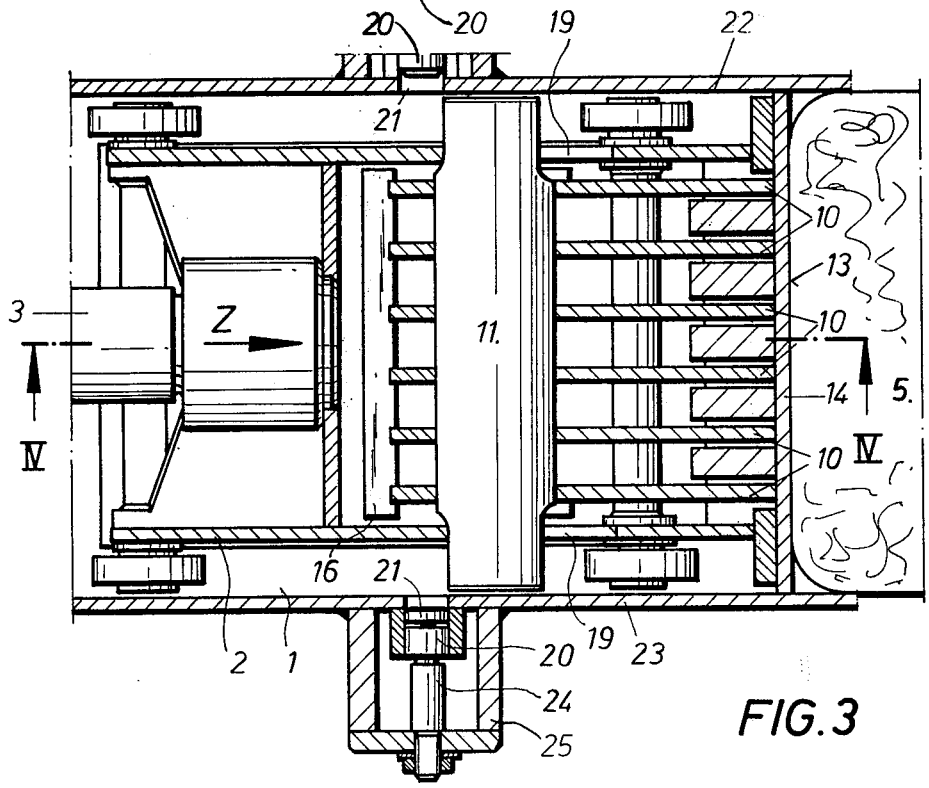
FIG. 3 is a section similar to FIG. 2, but showing the comb retracted.
Figure 4:
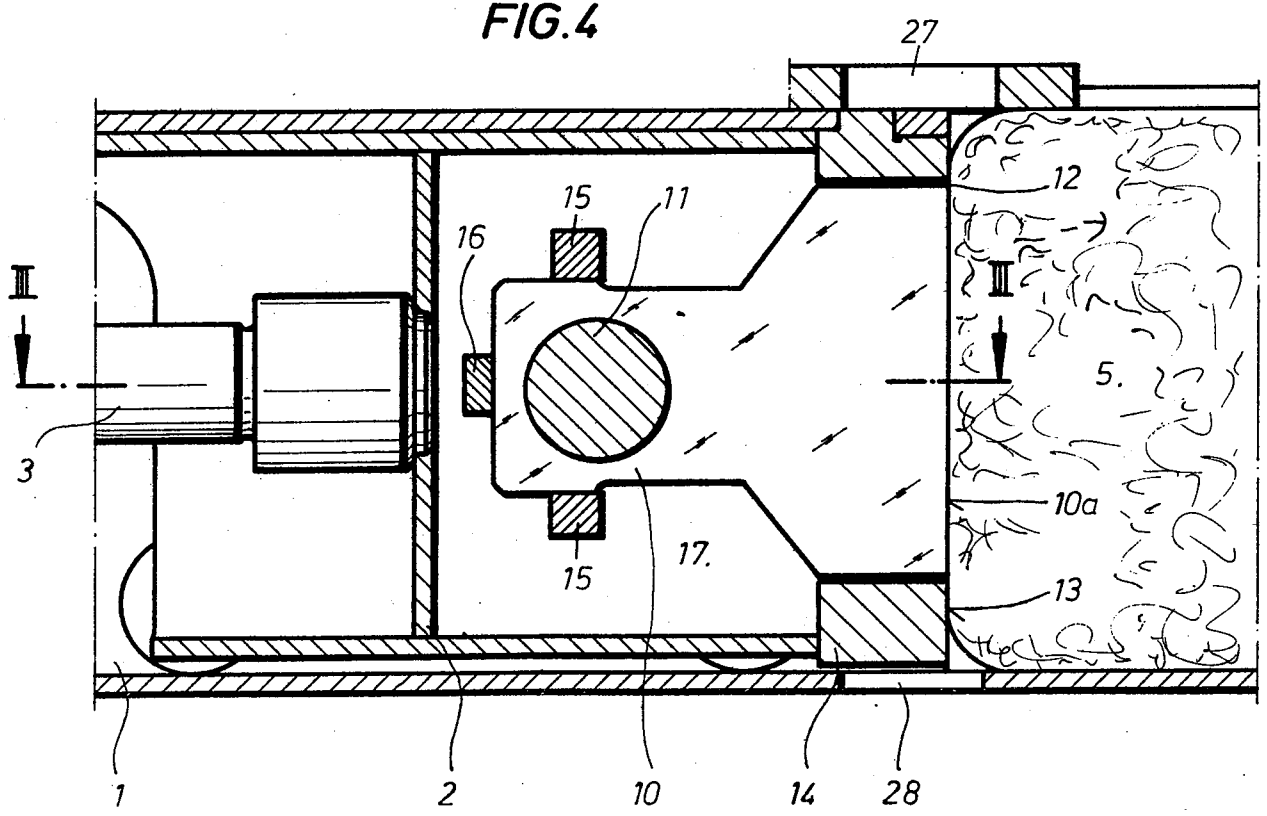
FIG. 4 is a section along the line IV—IV of FIG. 3.

As shown in FIG. 4, the plates 10 are guided at the front in apertures 12 in a front wall 14 of the pressing plunger 2. The wall 14 forms the pressing face 13 of the plunger. The plates 10 are guided at the back between two firmly fixed webs 15. The shape and size of the apertures 12 correspond to the cross-section of the front portions of the plates 10, so that in the retracted position of the comb shown in FIG. 3, the front faces 10a of the plates 10 form parts of the pressing face 13, which is then free of apertures. Inside the pressing plunger 2, the plates 10 are connected together and also kept parallel to one another at the desired spacing by means of a spacing bar 16. The connecting beam 11 is guided in longitudinal slots 19, disposed in side walls 17, 18 of the pressing plunger 2. The slots 19 permit displacement of the comb 9 in the pressing direction Z by a distance a, by which the comb is intended to be extended forwards from the pressing face 13. When the pressing plunger is in the limiting pressing position, locking pins 20 can be pushed through openings 21 in the side walls 22, 23 of the pressing box 1 behind the connecting beam 11, in order to lock the beam in position. Each locking pin 20 is connected to a hydraulic cylinder 24, which is attached through a housing 25 to one side wall 22 or 23 of the pressing box 1.

Figure 2:
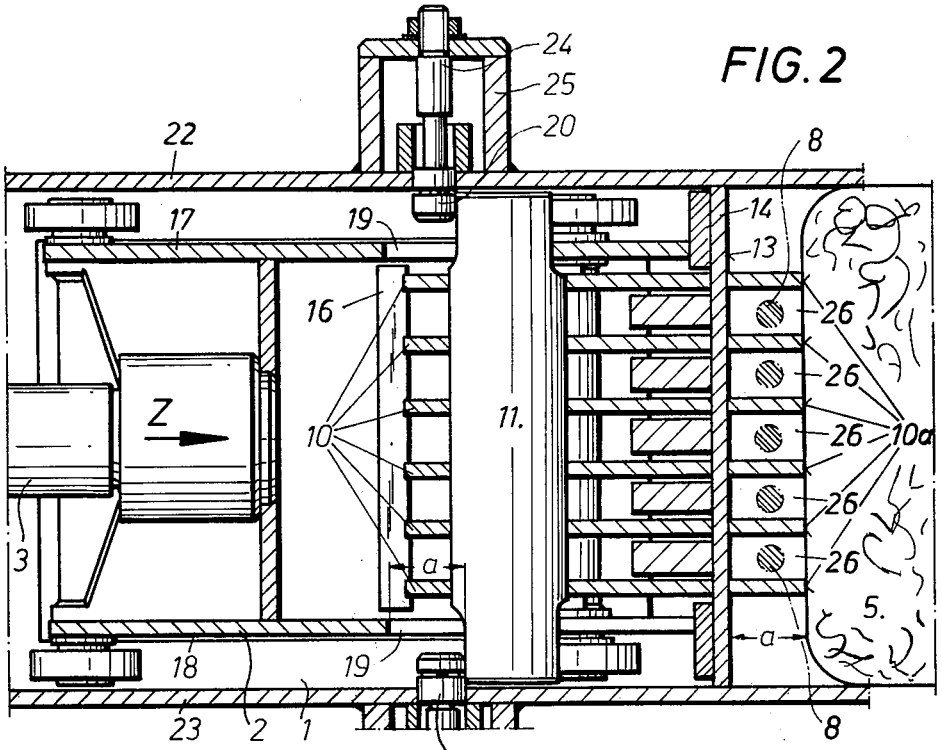
FIG. 2 is a section to a larger scale along the line II—II of FIG. 1 showing a binding comb of the press extended.

The cycle of binding operations starts in the stage of operations shown in FIGS. 3 and 4, at which instant the bale 5 has just been pressed and the pressing plunger 2 is in the limiting pressing position. The locking pins 20 are then pushed in behind the connecting beam 11. Next, the pressing plunger is retracted by the distance a into the position shown in FIGS. 1 and 2. During this movement, the comb 9 remains at rest, so that the comb, instead of the face 13 of the pressing plunger 2, presses against the rear face (in the direction of pressing) of the bale 5. This prevents the bale from expanding and at the same time opens out vertical, mutually parallel ducts 26, which are in alignment with openings 27, 28 in top and bottom walls of the pressing box for the conduction of the binding needles 8. These needles are indicated in FIG. 2 in broken line. The binding needles 8 are now lowered, in order to raise in a conventional manner wire loops 6a, 6b from each binding wire 6 as shown in FIG. 1. The loops are then cut, after which the wire end 6b at the rear end of the bale is twisted together with the previously formed wire end 6a upstanding at the forward face 29 of the bale. The binding operation is thus completed. The locking pins 20 are then retracted, so that the pressing plunger 2 can travel back into its left-hand limiting position (as viewed in FIG. 1). New material for the next bale then falls from the filling shaft 4 into the pressing box 1.

As the pressing plunger is retracted, the just formed binding comes free without hinderance from the pressing plunger, so that the operating difficulties which occur in known presses owing to clogging of the binding grooves are completely prevented. The wire end 6a, which up to this instant has remained in the binding needle 8, is hooked into a travelling crab 30 and is held there and guided until the next bale has been completed.

I claim:

1. In a baling press for the production of bound bales of predominantly non-metallic waste material, said press comprising a pressing box, a pressing plunger, said plunger including a front wall defining a pressing face of said plunger, means movably mounting said pressing plunger in said pressing box and means for moving said plunger to and fro in said pressing box in a pressing stroke and a retraction stroke, the improvement comprising a binding comb and means mounting said binding comb on said plunger for movement relative to said plunger between a forward position and a retracted position, said binding comb comprising a plurality of plates having front edges, means mounting said plates parallel to and spaced apart from one another, and means for moving said plates between a forward position corresponding to said forward position of said comb and a retracted position corresponding to said retracted position of said comb, said plates, when in said forward position, projecting beyond said pressing face of said plunger and defining therebetween a plurality of grooves for the passage of binding wire in front of said plunger and, when in said retracted position, having said front edges forming parts of said pressing face of said plunger.

2. A baling press as claimed in claim 1, further comprising means defining apertures in said front wall, said plates including front portions, said front portions being guidingly received and fitting one in each of said apertures, the size and shape of said apertures corresponding to the cross-section of said front portions of said plates.

3. A baling press as claimed in claim 1, further comprising a connecting beam extending through said pressing plunger perpendicularly to the direction of movement thereof in said pressing box and means within said pressing plunger fixing said plates to said beam.

4. A baling press as claimed in claim 3, wherein said pressing plunger and said pressing box each include two opposite side walls, means defining longitudinal slots one in each of said opposite side walls of said plunger, said connecting beam being guidingly received in said longitudinal slots, means defining openings in said opposite side walls of said pressing box, locking pin means and means for projecting said locking pins through said openings in said opposite side walls of said pressing box when said pressing plunger is in said forward position, said pins, when projected through said openings, being operative to lock said beam against rearward movement with said plunger.

5. A baling press as claimed in claim 4, wherein said means for projecting said pin means through said openings includes hydraulic cylinders, means mounting said hydraulic cylinders one on each of said side walls of said pressing box and means drivingly connecting said hydraulic cylinders to said pin means.

* * * * *